US005548537A

United States Patent [19]

Taguchi

[11] Patent Number: 5,548,537

[45] Date of Patent: Aug. 20, 1996

[54] ADJUSTING METHOD FOR AN ELECTRONIC PART

[75] Inventor: Minoru Taguchi, Saitama-ken, Japan

[73] Assignee: Pioneer Electronic Corporation, Tokyo, Japan

[21] Appl. No.: 374,124

[22] Filed: Jan. 18, 1995

[30] Foreign Application Priority Data

Jan. 19, 1994 [JP] Japan ..... 6-003888

[51] Int. Cl.[6] ..... G06G 7/30; G06G 7/62

[52] U.S. Cl. ..... 364/571.02; 364/481; 364/487; 364/577; 364/579; 364/571.01; 364/571.05

[58] Field of Search ..... 364/571.01, 571.02, 364/571.05, 487, 481, 577, 579

[56] References Cited

U.S. PATENT DOCUMENTS 2,977,535 3/1961 O'Connor ..... 324/73

4,300,196 11/1981 Lopresti ..... 364/489

4,686,627 8/1987 Donovan ..... 364/481

4,819,178 4/1989 Isayama ..... 364/481

*Primary Examiner*—Emanuel T. Voeltz

*Assistant Examiner*—Hien X. Vo

*Attorney, Agent, or Firm*—Sughrue, Mion, Zinn, Macpeak & Seas

[57] ABSTRACT

Output signals of an electronic part are sampled at regular intervals, and a function representing a relationship between the output signal and a changing quantity of a characteristic of the electronic part is calculated with an interpolation formula. A changing quantity for setting the output signal to a desired value is calculated with the calculated function, and electronic part is adjusted by the calculated changing quantity.

5 Claims, 9 Drawing Sheets

ADJUSTING METHOD FOR AN ELECTRONIC PART

BACKGROUND OF THE INVENTION

The present invention relates to a method for automatically adjusting a value of an electronic part such as a coil, a resistor and a trimmer capacitor mounted on a printed circuit board.

It is preferable that the electronic part on the printed circuit board is automatically adjusted to a proper value in dependency on an operation of a circuit.

In the automatic adjustment, an output signal at a measuring point of the printed circuit board is measured when operating, and an adjusting member of the electronic part is rotated with a screw driver until the output signal becomes a desired value.

FIG. 6 shows a flowchart of an operation for an adjusting method of a conventional automatic adjusting system. The output signal of the circuit is measured at a step 101. The adjusting member of the electronic part is rotated at a step 102. The output signal is measured at a step 103. A deviation of the output signal from the desired value is calculated at a step 104. At a step 105, it is determined whether the deviation becomes zero or not. If not, the program returns to the step 102. The rotation of the adjusting member is adjusted in dependency on the deviation until the deviation becomes zero at the step 105.

FIG. 7 shows the relationship between the output signal and the rotating angle of the adjusting member in the operation of the flowchart.

FIG. 8 shows an adjusting method of another conventional adjusting system. The output signals are measured at a step 301. A function representing the relationship between the adjustment quantity and the output signal is experimentally or logically obtained. In order to obtain the function, since output signals at a plurality of measuring points must be measured, a long time will be required to obtain the function. Therefore it is determined whether the function is complicated at a step 302. If not, the adjustment quantity is calculated at a step 303 with the function. The adjusting member is rotated in accordance with the calculated adjusting quantity at a step 304, and the program is terminated. If the function is complicated at the step 302, the program proceeds to a step 305 where a data which is previously calculated and stored in a memory is derived from the memory. The program goes to the step 304.

FIG. 9 shows a characteristic between the output signal and the rotating angle of the adjusting member.

FIG. 10 shows an operation of a driving control section provided in the system of FIG. 6. In the section, the adjusting member is rotated (step 501) until a stop command is produced (step 502).

FIG. 11 shows an operation of a measuring control section provided in the system of FIG. 6. In the section, the output signal is measured (step 601) until the desired value is obtained (step 602). When the desired value is obtained, the stop command is set (step 603).

FIG. 12 shows a characteristic between the output signal and the rotating angle in dependency on the operations of FIGS. 10 and 11.

In the former method, the number of samplings for measuring the output signal is large, so that it takes a long time to accomplish the adjustment.

Also in the latter method, a long time is required to measure output signals at a plurality of points. A part having a different shape can not be adjusted by the method. The method can not respond to a non-linear response characteristic. Furthermore, it is necessary to provide a separating process for inspecting an adjusting range.

SUMMARY OF THE INVENTION

An object of the present invention is to provide an adjusting method for electronic parts where the electronic part is automatically and properly adjusted at a high speed.

According to the present invention, there is provided a method for adjusting an electronic part, comprising the steps of sampling, at regular intervals, output signals corresponding to changing quantity of a characteristic of the electronic part, calculating a function representing a relationship between the output signal and the changing quantity with an interpolation formula, calculating a changing quantity for setting the output signal to a desired value with the calculated function, and an adjusting electronic part by the calculated changing quantity.

A maximum value, a minimum value and a variable range of the output signal are further calculated.

These other objects and features of this invention will become understood from the following description with reference to the accompanying drawings.

DETAILED DESCRIPTION OF THE PREFERRED EMBODIMENTS

Figure 1:
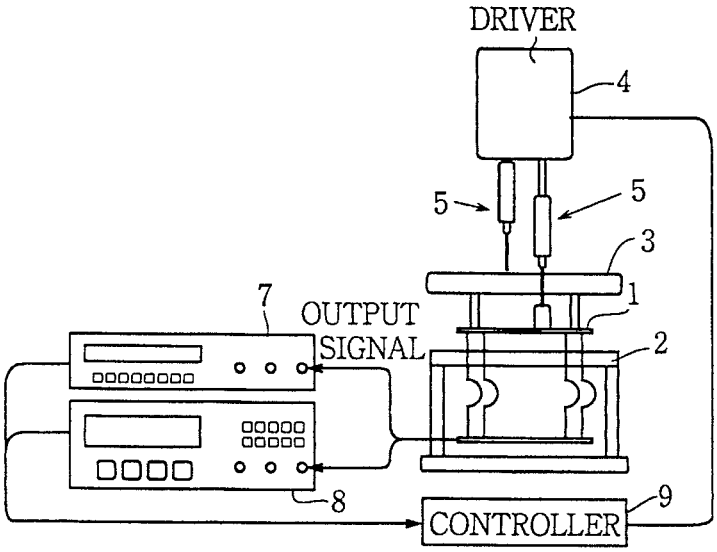
FIG. 1 is a schematic diagram showing an automatically adjusting system for an electronic part according to the present invention.
Figure 2:
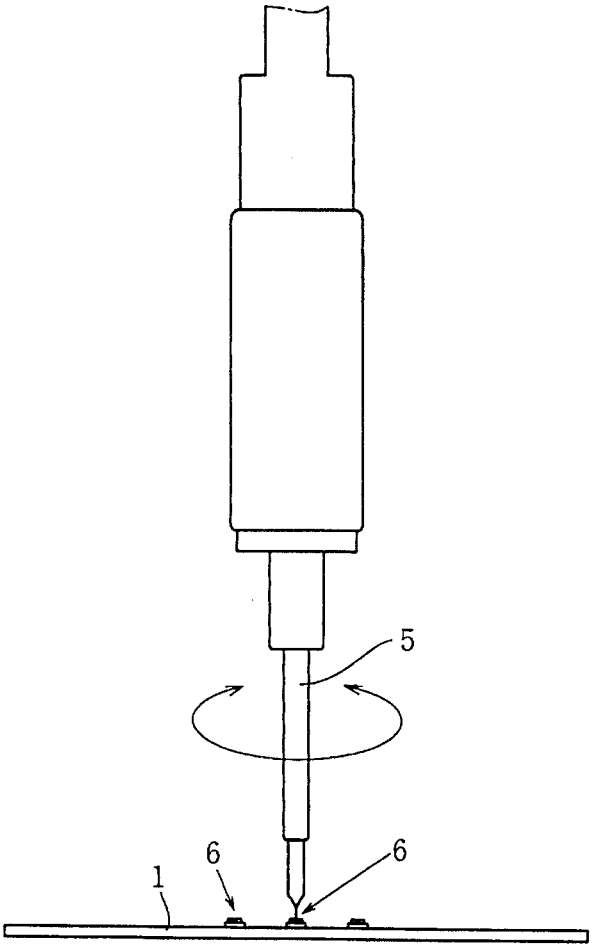
FIG. 2 is a side view showing a driver bit of the system.

Referring to FIG. 1, an adjusting system for an electronic part according to the present invention has a sensing-pin plate 2 on which a printed circuit board 1 is mounted and secured thereto by a holder frame 3. Driver bits are provided on an upper portion of the holder frame 3 to be driven by a driver 4. As shown in FIG. 2, electronic parts 6 are mounted on the printed circuit board 1. An adjusting member of the electronic part 6 is rotated by the driver bit 5 and produces an output signal representing an operating characteristic of the circuit. The sensing-pin plate 2 is connected to measuring devices 7 and 8 to which output signals representing operating characteristics of the circuit are applied. Each of the measuring devices 7 and 8 produces a signal of a measured value which is applied to a controller 9 for controlling the driver 4.

Figure 3:
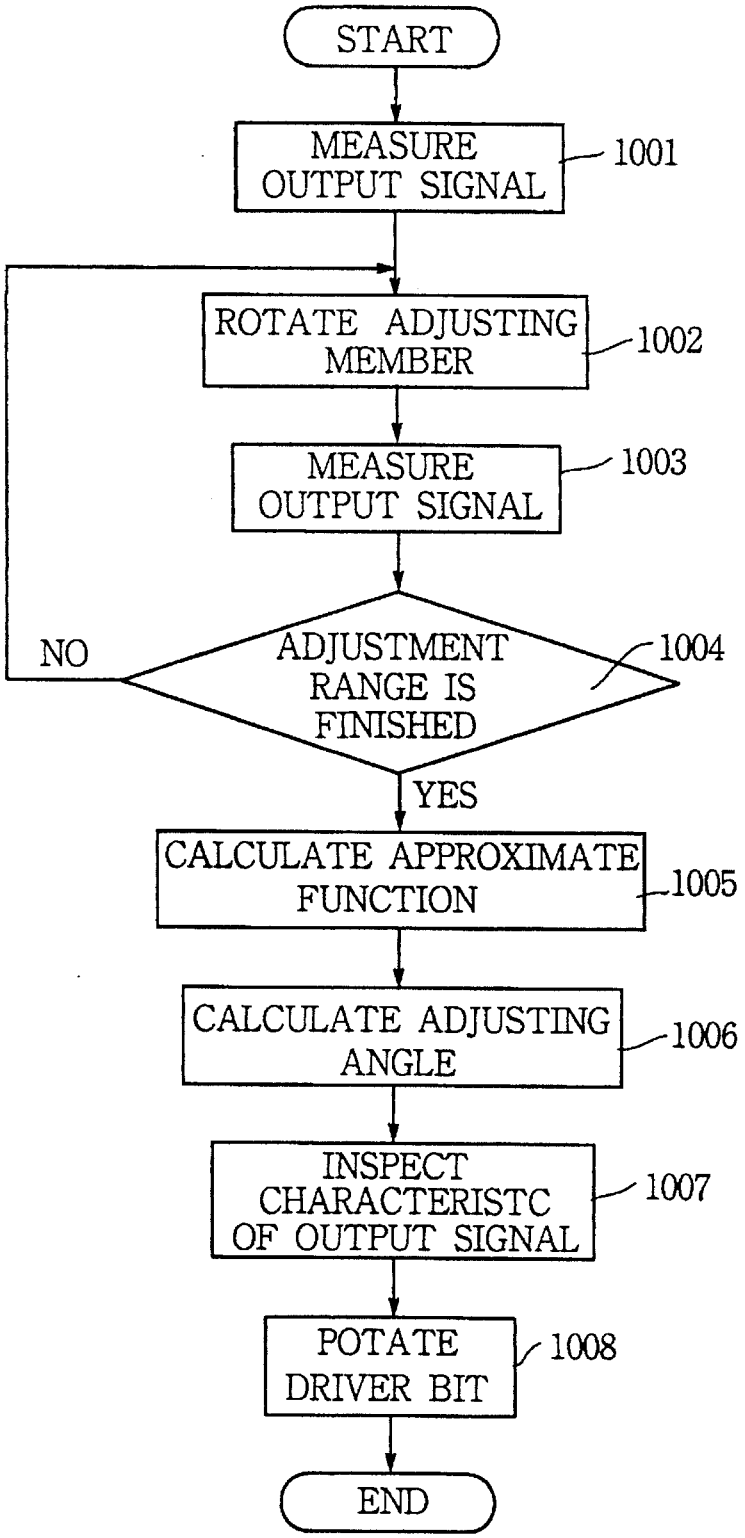
FIG. 3 is a flowchart showing an adjusting operation of the system.
Figure 4:
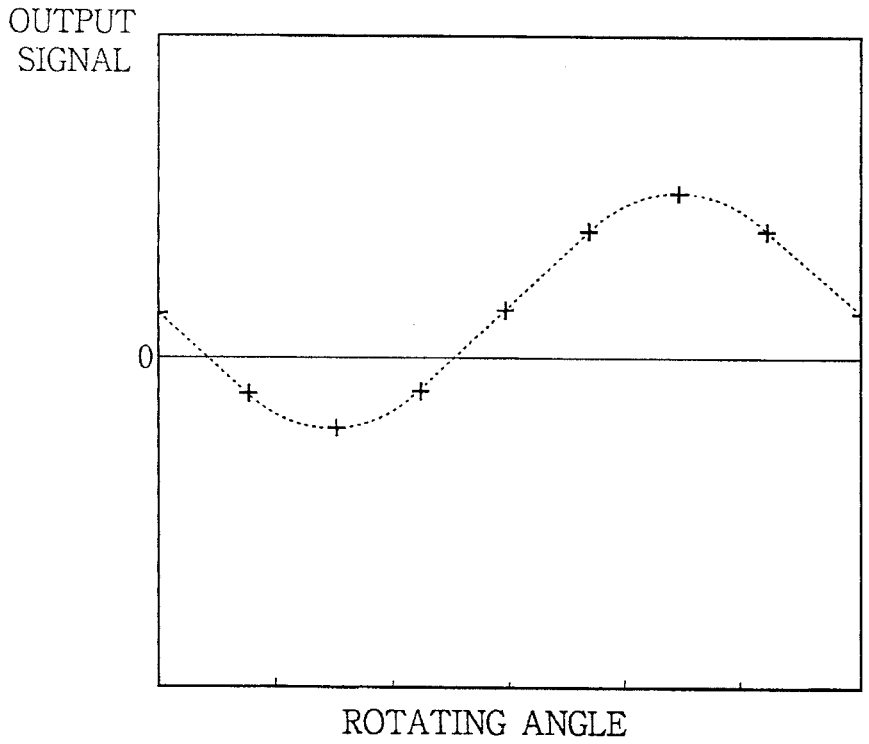
FIG. 4 is a diagram showing the relationship between an output signal and a rotating angle of the part.

FIG. 3 shows an adjusting operation of the system. An output signal is measured at a step 1001. The adjusting member of the electronic part 6 is rotated by the driver bit 5 at a step 1002. The output signal is measured at a step 1003. At a step 1004, it is determined whether the adjusting member is rotated in the entire range of adjustment or not. As shown in FIG. 4, the output signal is roughly sampled at considerably large angular intervals and measured at those measuring points. A cross mark represents a sampled point. If the adjusting member is rotated in the entire range at the step 1004, an approximate function representing the relationship between the adjustment (changing) quantity and the output signal is calculated by an interpolation formula at a step 1005. The interpolation formula is, for example, Lagrange's, Newton's and method of least squares. An adjusting angle to a desired value is calculated with the function at a step 1006. In accordance with the obtained function, data of output signal such as a maximum value, a minimum value, and a variable range are obtained at a step 1007 without measuring actual data. At a step 1008, the adjusting member is rotated the calculated adjusting angle by the driver bit 5, thereby converging the output signal to the desired value. The function is obtained at every part.

In accordance with the present invention, the measuring number of output signals is reduced, thereby reducing the inspecting time for the part. Since the relationship between the adjusting quantity and the output signal is obtained to calculate the approximate function at every part, the electronic part having the different shape can be adjusted and the non-linear response characteristic can be inspected. Thus, the automatic adjustment is properly operated at a high speed, because of the rough sampling.

Figure 5:
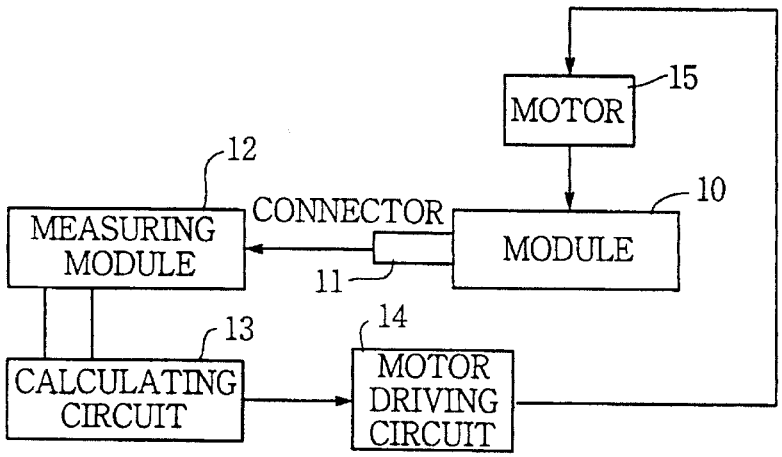
FIG. 5 is a block diagram showing another embodiment of the present invention.
Figure 6:
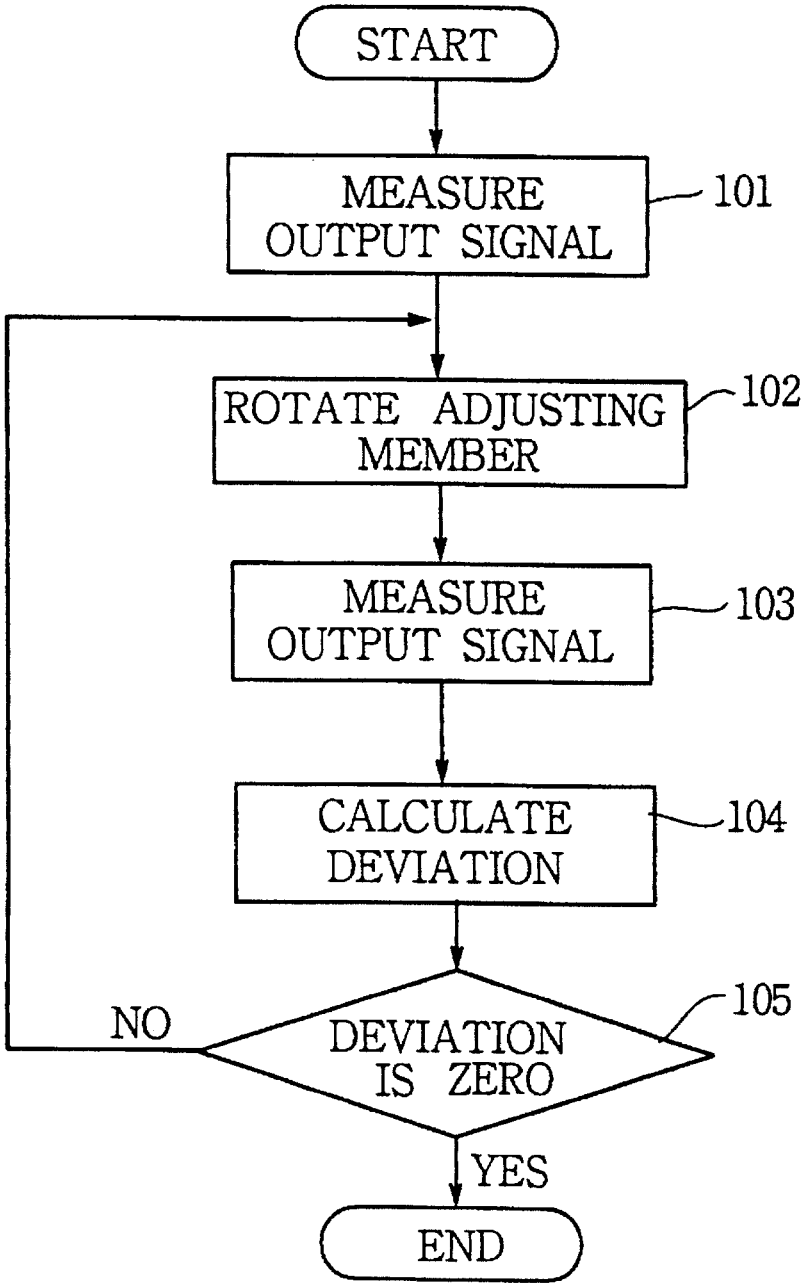
FIG.6 PRIOR ART
FIG. 6 is a flowchart showing an adjusting operation of a conventional adjusting system.
Figure 7:
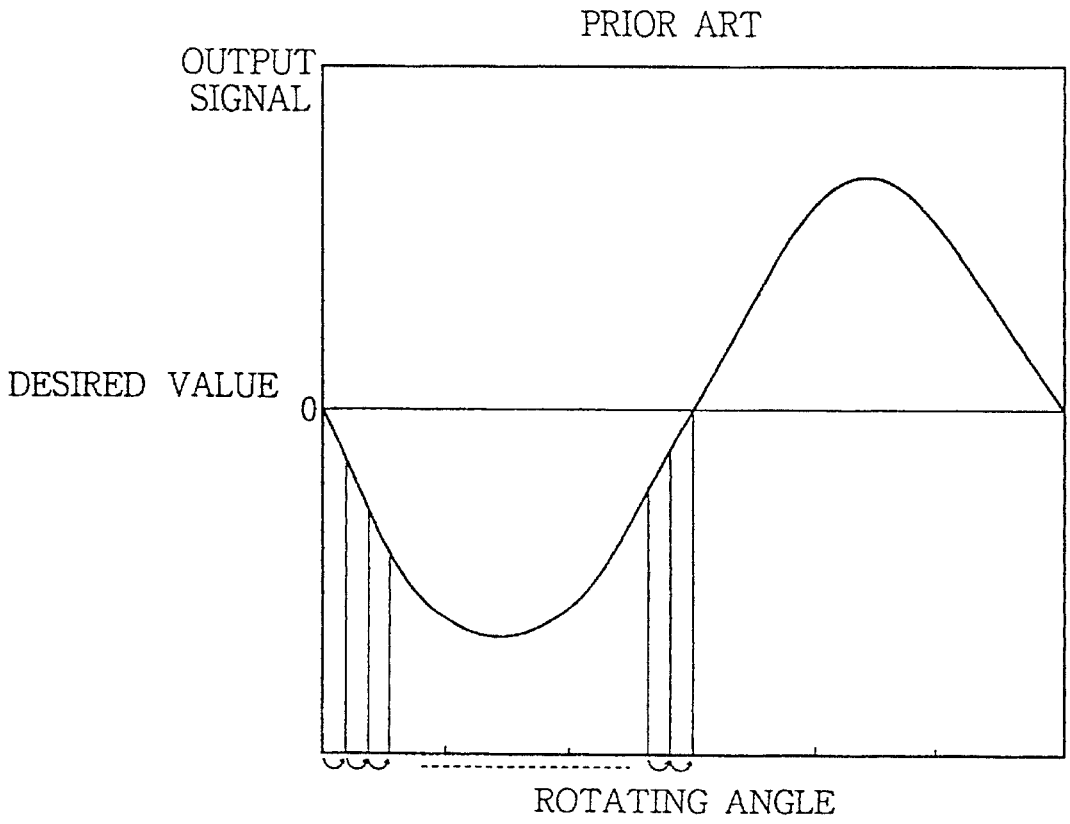
FIG. 7 is a diagram showing the relationship between an output signal and a rotating angle of the conventional system.
Figure 8:
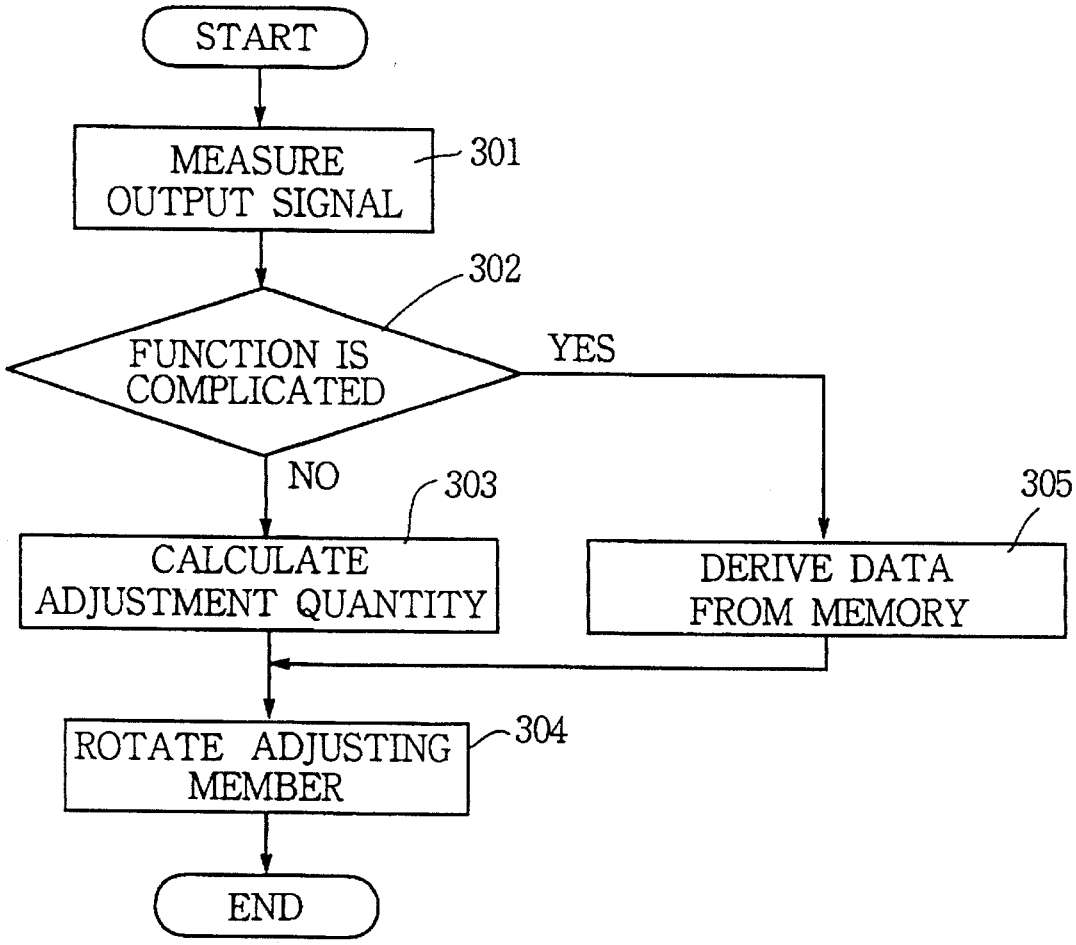
FIG.8 PRIOR ART
FIG. 8 is a flowchart showing an adjusting operation of another conventional adjusting system.
Figure 9:
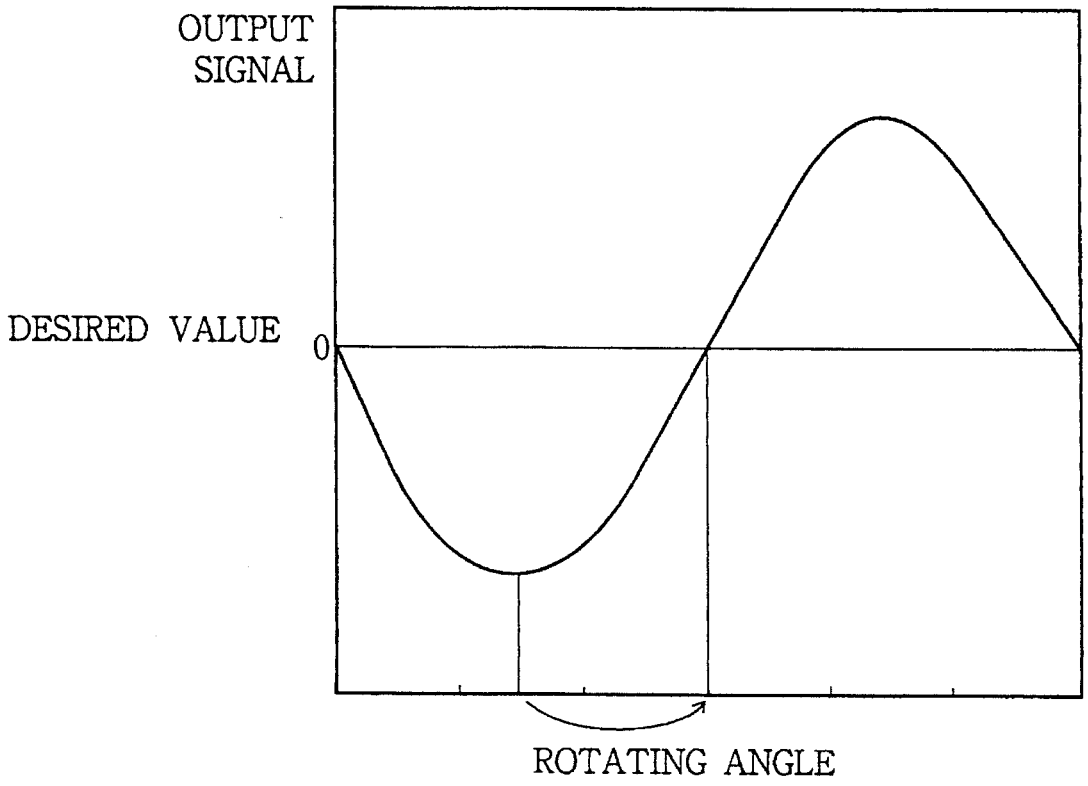
FIG.9 PRIOR ART
FIG. 9 is a diagram showing a characteristic between an output signal and a rotating angle of the system of FIG. 8.
Figure 10:
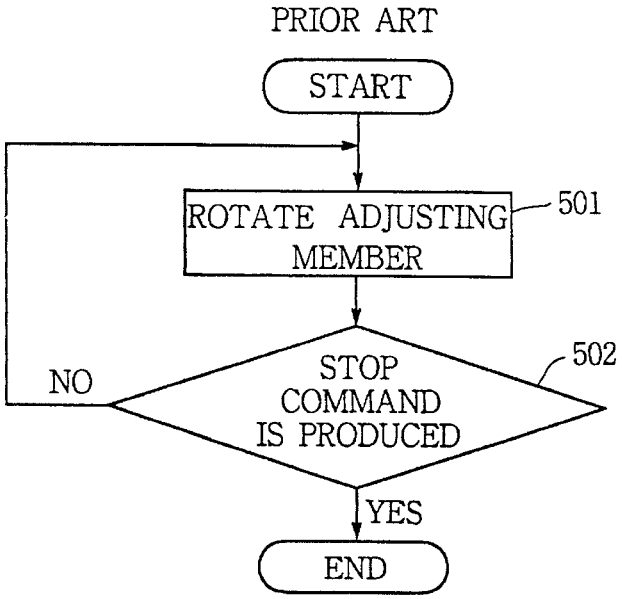
FIG. 10 is a flowchart showing an operation of a driving controller provided in the conventional system of FIG. 8.
Figure 11:
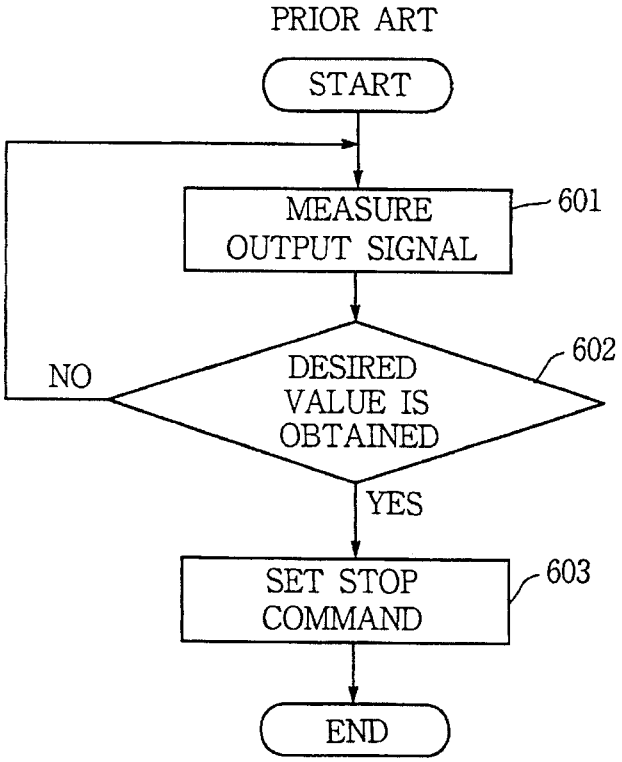
FIG. 11 is a flowchart showing an operation of a measuring controller provided in the conventional system of FIG. 8.
Figure 12:
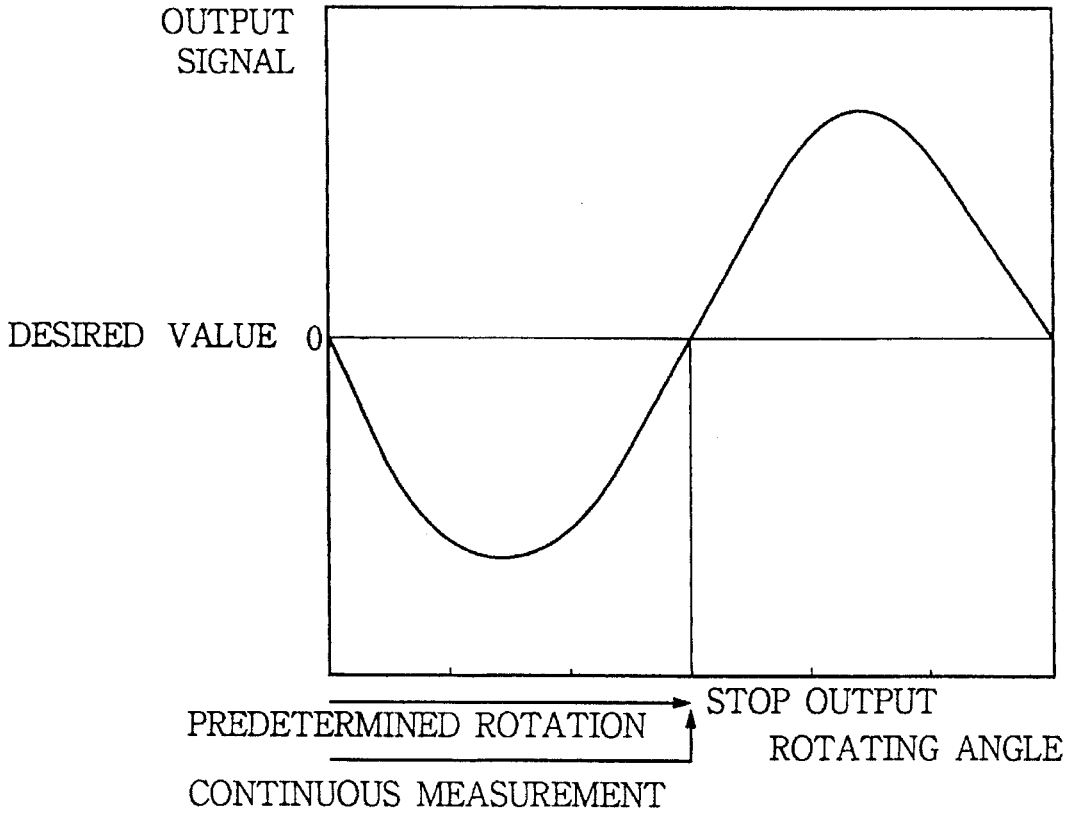
FIG.12 PRIOR ART
FIG. 12 is a diagram showing a characteristic between the output signal and the rotating angle in accordance with the operations of FIGS. 10 and 11.

FIG. 5 shows another embodiment where a unit or a module is inspected in place of the printed circuit board of FIG. 1. An output signal of a module 10 is applied to a measuring module 12 through a connector 11. The output signal is measured and converted into a digital signal which is applied to a calculating circuit 13. The calculating circuit 13 calculates results of inspection and results of adjustment of the output signal, and produces a control signal with the function for converging the output signal to a desired value. The control signal is applied to a motor driving circuit 14 for driving a motor 15.

In the embodiment, it is possible to adjust the output signal without using the measuring device, thereby increasing the speed of the adjusting time.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A method for adjusting an electronic part which has a characteristic changeable across a range of values, comprising the steps of:

sampling output signals corresponding to values of the characteristic of the electronic part, said values separated from one another at regular intervals;

calculating a function representing a relationship between the sampled output signals and said values of the characteristic with an interpolation formula:

calculating a changing value of the characteristic to set the output signal to a desired value using the calculated function; and adjusting the characteristic of the electronic part in accordance with the calculated changing value.

2. The method according to claim 1 further comprising the step of: calculating a maximum value, a minimum value and a variable range of the output signal using the calculated function.

3. The method according to claim 1, wherein the interpolation formula used in the step of calculating a function is LaGrange's interpolation formula.

4. The method according to claim 1, wherein the interpolation formula used in the step of calculating a function is Newton's interpolation formula.

5. The method according to claim 1, wherein the interpolation formula used in the step of calculating a function is the method of least squares interpolation formula.

* * * * *